US006220942B1

(12) United States Patent
Tolles et al.

(10) Patent No.: US 6,220,942 B1
(45) Date of Patent: Apr. 24, 2001

(54) CMP PLATEN WITH PATTERNED SURFACE

(75) Inventors: Robert D. Tolles, Santa Clara; Steven T. Mear, Los Gatos; Gopalakrishna B. Prabhu, Sunnyvale; Sidney Huey, Milpitas; Fred C. Redeker, Fremont, all of CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/285,508

(22) Filed: Apr. 2, 1999

(51) Int. Cl.[7] ..... B24B 7/04

(52) U.S. Cl. ..... 451/65; 451/287; 451/290; 451/533; 451/537; 451/550

(58) Field of Search ..... 451/65, 285, 286, 451/287, 288, 289, 290, 533, 534, 537, 548, 550, 53, 449, 488

(56) References Cited

U.S. PATENT DOCUMENTS 2,819,568 * 1/1958 Kasick .
5,076,024 * 12/1991 Akagawa et al. ..... 451/550
5,212,910 * 5/1993 Breivogel et al. ..... 451/533 X
5,403,228 4/1995 Pasch ..... 451/259
5,486,129 1/1996 Sandhu et al. ..... 451/5
5,624,304 4/1997 Pasch et al. ..... 451/287
5,658,183 8/1997 Sandhu et al. ..... 451/5
5,664,989 * 9/1997 Nakata et al. ..... 451/41
5,679,064 * 10/1997 Nishi et al. ..... 451/550 X
5,718,620 * 2/1998 Tanaka et al. ..... 451/288
5,730,642 3/1998 Sandhu et al. ..... 451/6
5,738,574 4/1998 Tolles et al. ..... 451/288
5,853,317 * 12/1998 Yamamoto ..... 451/288
5,873,769 * 2/1999 Chiou et al. ..... 451/7

* cited by examiner

*Primary Examiner*—Timothy V. Eley
(74) *Attorney, Agent, or Firm*—Thomason, Moser & Patterson

(57) ABSTRACT

A chemical mechanical polishing system is provided having one more polishing stations. The polishing stations include a platen and pad mounted to an upper surface of the platen. The upper surface of the platen is patterned to define a raised area and a recessed area. The raised area provides a rigid mounting surface for the pad and the recessed area provides the pad a desired degree of flexibility and compliance of the pad when brought into contact with a substrate.

26 Claims, 5 Drawing Sheets

CM P PLATEN WITH PATTERNED SURFACE

BACKGROUND OF THE INVENTION

1. Field of the Invention

The present invention relates to an apparatus for polishing substrates. More particularly, the invention relates to a platen/polishing pad assembly having a compliant surface to improve polishing uniformity of substrates.

2. Background of the Related Art

In the fabrication of integrated circuits and other electronic devices, multiple layers of conducting, semiconducting and dielectric materials are deposited and removed from a substrate during the fabrication process. Often it is necessary to polish a surface of a substrate to remove high topography, surface defects, scratches or embedded particles. The polishing process is often referred to as chemical mechanical polishing (CMP) and is used to improve the quality and reliability of the electronic devices formed on the substrate.

Typically, the polishing process involves the introduction of a chemical slurry during the polishing process to facilitate higher removal rates and selectivity between films on the substrate surface. In general, the polishing process involves holding a substrate against a polishing pad under controlled pressure, temperature and rotational speed (velocity) of the pad in the presence of the slurry or other fluid medium. One polishing system that is used to perform CMP is the Mirra® CMP System available from Applied Materials, Inc., and shown and described in U.S. Pat. No. 5,738,574, entitled, "Continuous Processing System for Chemical Mechanical Polishing," the entirety of which is incorporated herein by reference.

An important goal of CMP is achieving uniform planarity of the substrate surface. Uniform planarity includes the uniform removal of material deposited on the surface of substrates as well as removing non-uniform layers which have been deposited on the substrate. Successful CMP also requires repeatability from one substrate to the next. Thus, uniformity must be achieved not only for a single substrate, but also for a series of substrates processed in a batch.

Substrate planarity is dictated, to a large extent, by the construction of the CMP apparatus and the consumables such as slurry and pads. In particular, a preferred construction allows for a proper balance between rigidity (or stiffness) and compliance (or flexibility) of the polishing device, and in particular to the stiffness and compliance of the polishing pad. In general, stiffness is needed to ensure within-die uniformity while sufficient compliance provides within-substrate uniformity. Within-substrate uniformity refers to the ability of the CMP apparatus to remove features across the diameter of the substrate regardless of substrate shape and/or topography across its surface. Within-die uniformity refers to the ability of the CMP apparatus to remove features within a die, regardless of size and feature density.

Conventional polishing systems include a platen having a polishing pad disposed thereon. Current state of the art strongly suggests the use of more than one polishing pad to provide compliance to the pad for improved results both withinsubstrate and within-die. For example, two pads are typically assembled together into a stack, which may be termed a "composite polishing pad." A typical polishing apparatus 10 comprising a metal platen 12 having a composite polishing pad 14 mounted thereto is shown in FIG. 1. Both the composite polishing pad 14 and the platen 12 are generally disc-shaped and of equal diameters. The top (upper) pad 16, is brought into contact with a substrate to perform the polishing process, while the bottom (lower) pad 18 is secured to a smooth upper mounting surface of the rotatable platen 12 to provide a seating surface for the top pad 16. An adhesive 20, such as a pressure sensitive adhesive (PSA) is provided on the back face of the pads 16, 18 to bond the pads to one another and to the platen 12. The top pad 16 is typically made of cast polyurethane while the bottom pad 18 is typically made of polyester felt stiffened with polyurethane resin. Other pads having different material composition are also available and known in the industry.

Generally, it is preferable that the top pad 16 be stiffer than the more compliant bottom pad 18 to provide a sufficiently rigid polishing surface. Typically, stiffness provides better within-die uniformity, while some compliance is needed to ensure within-substrate uniformity. The combination of pads having the proper proportions of stiffness and flexibility can achieve good planarity and uniformity over the surface of the substrate. In addition, the polishing profile on a substrate can be changed or modified by changing the thickness of either or both of the upper and lower pads. The change in thickness without a change in composition can change the properties of the composite pad in terms of stiffness and compliance.

However, a number of problems are associated with the conventional composite, or stacked, pad construction. In particular, each additional layer, i.e., pad and adhesive layer, in the stack acts as a source of variation affecting the overall stiffness and/or compliance of the stack. The greater the number of layers or even variations in the thickness of pads, the greater the potential for variation. As a result, a polishing device utilizing a composite polishing pad is often unable to achieve desired polishing results over a number of substrates. Specifically, variations in compressibility, loss of within-substrate uniformity, uncontrolled wetting of the lower pad, and variation from pad to pad result due to multiple process variables. In addition, the planarity changes as the top pad is worn away by a process known as conditioning the pad, and planarity may decrease with increasing number of substrates polished on the pad.

One solution has been to minimize the number of layers in the composite polishing pad. Thus, the goal in CMP would be to remove the bottom pad and secure the top pad directly to the upper surface of the platen. Removal of bottom pad also eliminates the need for one layer of the adhesive. However, it has been discovered that elimination of the bottom pad and mounting the polishing pad directly on the platen results in an overly rigid pad/platen assembly which compromises the compliance of the assembly. The rigidity is a consequence of directly interfacing the top pad with the non-compliant platen surface, typically made of aluminum or other metal.

Therefore, there is a need for a platen/pad assembly which eliminates the need for a sub-pad while providing sufficient compliance during polishing.

SUMMARY

The present invention generally provides an apparatus for polishing a substrate which enhances polishing pad compliance and maintains or improves substrate and die uniformity. The apparatus is preferably adapted for incorporation into a chemical mechanical polishing system.

In one aspect of the invention, a platen is provided having a patterned upper surface to define a raised area and a recessed area. The raised area provides a rigid mounting surface for a polishing pad, while the recessed area allows for a desired degree of compliance of the pad.

In another aspect of the invention, a platen is provided having a pad disposed thereon. The upper surface of the platen is patterned to define a raised pad seating area and a recessed area. The raised area provides a rigid mounting surface for the pad and the recessed area provides a desired degree of flexibility and compliance of the pad when brought into contact with a substrate. Preferably, a portion of the recessed area extends to the perimeter of the platen thereby forming pathways between the platen and the pad that communicate with the platen's environment.

In another aspect of the invention, a patterned surface is provided and is adapted to be disposed on the upper surface of a platen to support a polishing pad thereon. The patterned surface is preferably a hard rubber-like material defining an upper polishing pad supporting surface having channels or other recesses formed therein to provide pad compliance.

In another aspect of the invention, a platen having a patterned upper surface is provided and is coated with a rubber-like or compliant upper surface. The patterned surface includes both an upper pad supporting surface and a lower grooved portion for providing some compliance to the pad.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

The present invention generally relates to a platen having a patterned surface for mounting a pad, such as a polishing pad, thereto. The patterned surface includes a raised pad supporting portion and a recessed pad displacement portion. The raised portion defines a mounting surface for a polishing pad. The recessed portion provides a deflection area and is preferably vented to allow communication with the platen environment.

For clarity and ease of description, the following description refers primarily to a CMP system. However, the invention is equally applicable to other types of processes that utilize a platen and pad assembly for polishing or cleaning a substrate.

Figure 2:
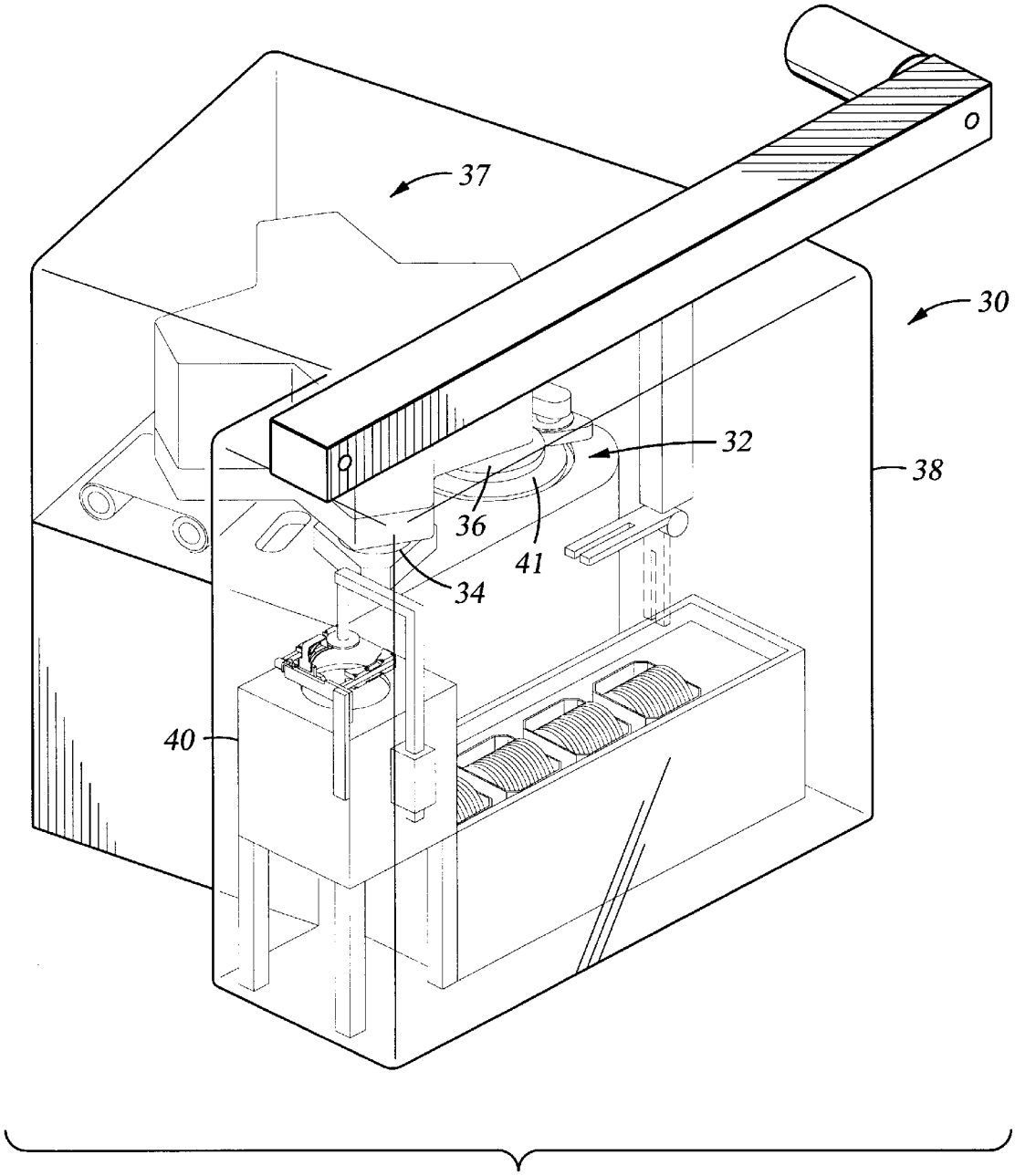
FIG. 2 is a schematic view of a CMP system.

FIG. 2 is a schematic view of a CMP system 30, such as a Mirra® CMP System available from Applied Materials, Inc., located in Santa Clara, Calif. The system shown includes three polishing stations 32 and a loading station 34. Four polishing heads 36 are rotatably mounted to a polishing head displacement mechanism 37 disposed above the polishing stations 32 and the loading station 34. A front-end substrate transfer region 38 is disposed adjacent to the CMP system and is considered a part of the CMP system, though the transfer region 38 may be a separate component. A substrate inspection station 40 is disposed on or near the substrate transfer region 38 to enable pre and/or post process inspection of substrates introduced into the system 30.

Typically, a substrate is loaded on a polishing head 36 at the loading station 34 and is then rotated through the three polishing stations 32. The polishing stations 32 each comprise a rotating platen 41 having polishing or cleaning pads mounted thereon described in detail below with reference to FIG. 3. One process sequence includes a polishing pad at the first two stations and a cleaning pad at the third station to facilitate substrate cleaning at the end of the polishing process. At the end of the cycle the substrate is returned to the front-end substrate transfer region 38 and another substrate is retrieved from the loading station 34 for processing.

Figure 3:
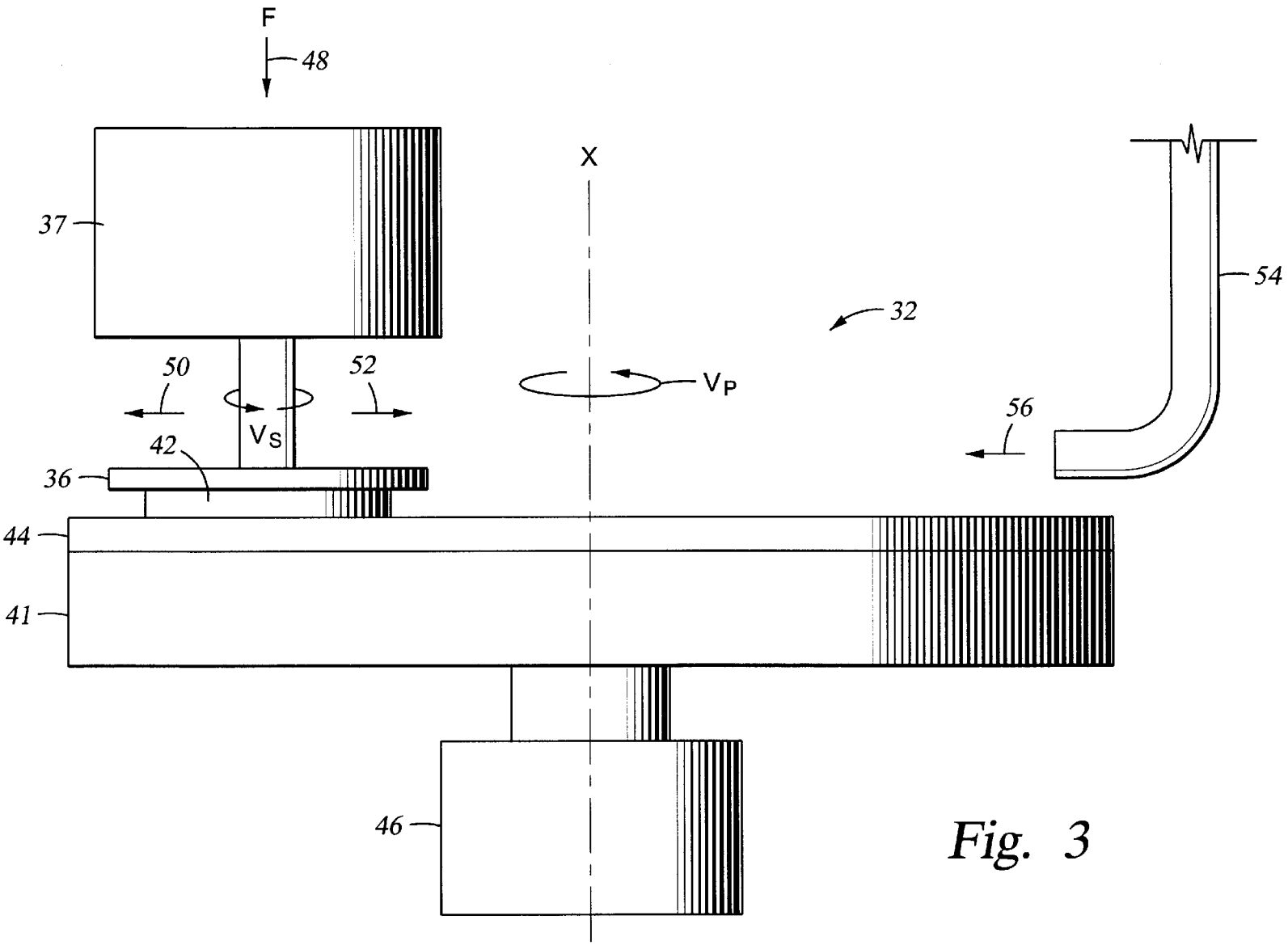
FIG. 3 is a schematic view of a polishing station.

FIG. 3 is a schematic view of a polishing station 32 and polishing head 36 used to advantage with the present invention. The polishing station 32 comprises a pad 44 secured to an upper surface of the rotatable platen 41. The pad 44 may be any commercially available pad supplied by manufacturers such as Rodel and preferably comprises a plastic or foam such as polyurethane. The platen 41 is coupled to a motor 46 or other suitable drive mechanism to impart rotational movement to the platen 41. During operation, the platen 41 is rotated at a velocity $V_p$ about a center axis X. The platen 12 can be rotated in either a clockwise or counterclockwise direction. FIG. 3 also shows the polishing head 36 mounted above the polishing station 32. The polishing head 36 supports a substrate 42 for polishing. The polishing head 36 may comprise a vacuum-type mechanism to chuck the substrate 42 against the polishing head 36. During operation, the vacuum chuck generates a negative vacuum force behind the surface of the substrate 42 to attract and hold the substrate 42. The polishing head 36 typically includes a pocket (not shown) in which the substrate 42 is supported, at least initially, under vacuum. Once the substrate 42 is secured in the pocket and positioned on the pad 44, the vacuum can be removed. The polishing head 36 then applies a controlled pressure behind the substrate, indicated by the arrow 48, to the backside of the substrate 42 urging the substrate 42 against the pad 44 to facilitate polishing of the substrate surface. The polishing head displacement mechanism 37 rotates the polishing head 36 and the substrate 42 at a velocity $V_s$ in a clockwise or counterclockwise direction, preferably the same direction as the platen 41. The polishing head displacement mechanism 37 also preferably moves the polishing head 36 radially across the platen 41 in a direction indicated by arrows 50 and 52.

With reference to FIG. 3, the CMP system also includes a chemical supply system 54 for introducing a chemical slurry of a desired composition to the pad. The slurry provides an abrasive material which facilitates the polishing of the substrate surface, and is preferably a composition formed of solid alumina or silica. During operation, the chemical supply system 54 introduces the slurry as indicated by arrow 56 on the pad 44 at a selected rate.

Figure 4:
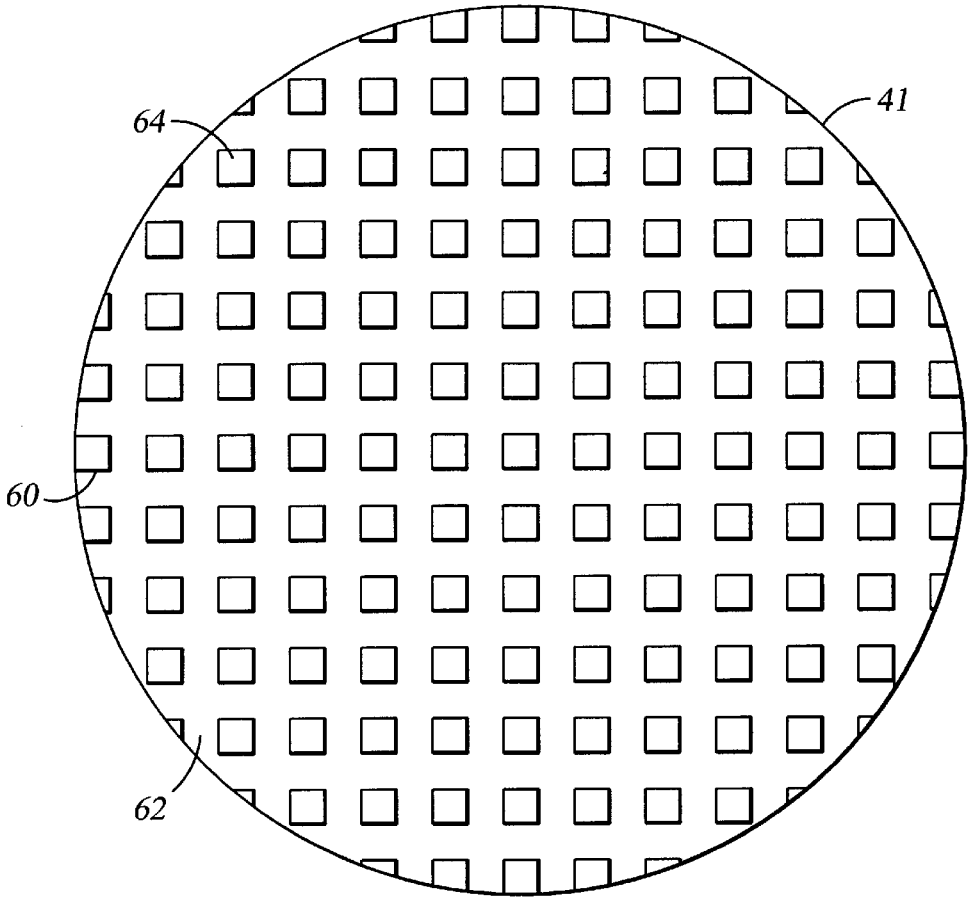
FIG. 4 is a top view of the platen.

FIG. 4 shows a preferred embodiment of a platen 41 of the invention. The platen 41 comprises a patterned surface whereon a polishing pad may be disposed. Generally, the patterned surface has features formed therein defining a raised area and a recessed area. In the embodiment shown in FIG. 4, the raised area consists of a plurality of protrusions 60 while the recessed area is a plurality of intersecting grooves 62 defined by the protrusions 60. More specifically, the recessed area consists of two parallel sets of equally spaced orthogonally intersecting grooves 62 in a checkerboard pattern. Each groove 62 traverses the upper surface of the platen 41 from one perimeter to the another. Thus, the grooves 62 are not contained, or blocked, at either end. However, the present invention also contemplates an embodiment having blocked grooves.

Figure 1:
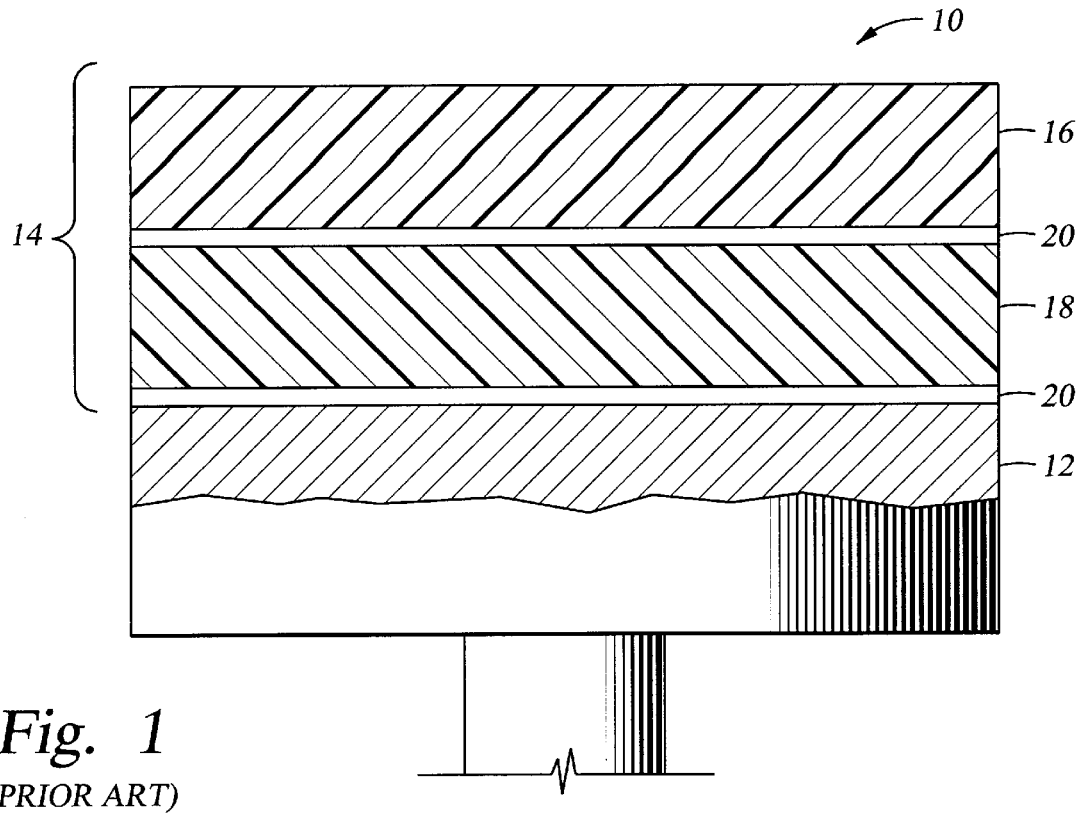
Fig. 1 (PRIOR ART)
FIG. 1 is a schematic side view of a platen and composite polishing pad assembly.
Figure 5:
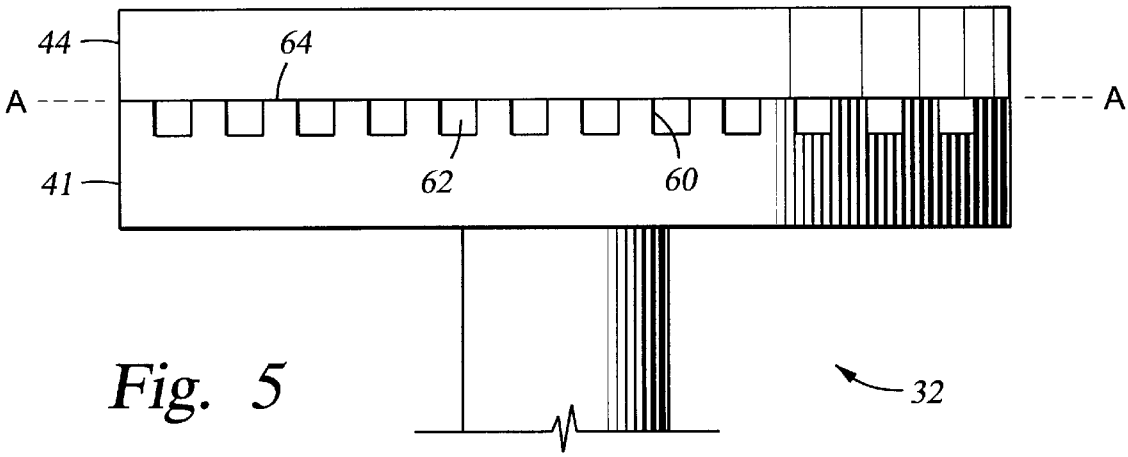
FIG. 5 is a schematic side view of the platen in FIG. 4 having a pad disposed thereon.

The raised area of the platen 41, or protrusions 60, defines a pad mounting surface. Preferably, the protrusions 60 cooperate to provide a substantially planar mounting surface 64 along a common plane A for supporting a polishing pad 44 as shown in FIG. 5. The pad 44 is attached using a commercially available pressure sensitive adhesive (PSA). Thus, the present invention eliminates the bottom pad of prior art as discussed with reference to FIG. 1. Further, the necessary pad compliance, previously achieved by using a bottom pad, is now provided by the cooperation of the recessed and raised areas, or grooves 62 and protrusions 60, respectively. The protrusions 60 ensure sufficient rigidity (or stiffness) while the grooves 62 allow the proper proportion of pad compliance to accommodate a substrate's varying topography.

Figure 6:
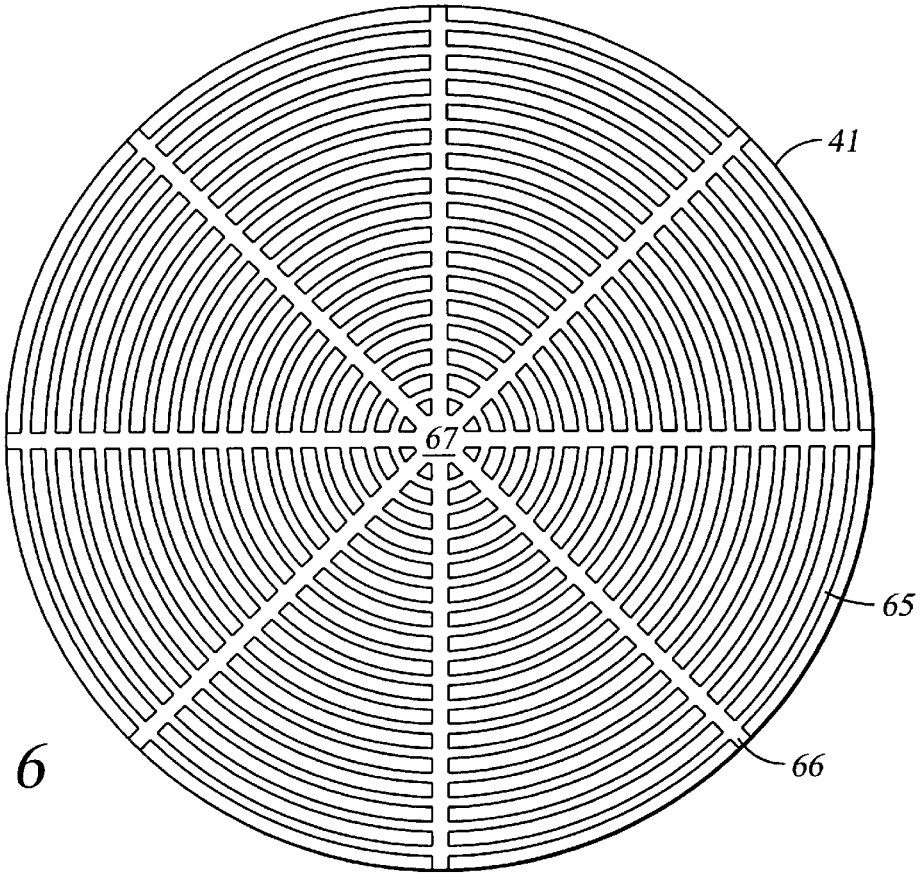
FIG. 6 is a top view of the platen showing an alternative embodiment.

As noted above, the grooves 62 are preferably open at some point along their length to prevent vacuum adherence of the pad to the surface. Thus, the grooves 62 provide pathways between the platen 41 and the pad 44 which vent to the environment of the platen 41 as shown in FIG. 5. Such a construction anticipates the use of perforated pads such as those available from Rodel. The perforations in the pad allow fluid flow therethrough. Where the grooves 62 are isolated from the environment, such as where the grooves 62 comprise concentric circles enclosed at the top by a perforated pad, a partial vacuum condition may be created in the grooves 62 as a substrate is urged against the pad. In such a case, the substrate remains chucked to the pad after the polishing cycle making it difficult to remove. By constructing the grooves 62 as shown in FIGS. 4 and 5, the grooves 62 remain at equal pressure to the ambient environment allowing easy dechucking of the substrate. Where a concentric pattern is desired, a vent channel or channels extending to the perimeter of the platen 41 can be provided to eliminate adhesion between the substrate and platen 41. Such an embodiment is shown in FIG. 6 and described in detail below.

Preferably, the protrusions 60 and the grooves 62 shown in FIGS. 4 and 5 are defined by machining away a portion of the upper surface of the platen 41 which comprises a metal such as aluminum. However, the present invention also contemplates alternative embodiments. For example, the plurality of protrusions 60 may be constructed separately from the platen 41. The protrusions 60 may then be secured to the platen 41 surface by conventional methods such as brazing or welding. In another alternative, the platen 41 may comprise two separable plates with a lower plate secured to the motor 46 (shown in FIG. 3) and an upper plate comprising the patterned surface for mounting the pad 44. The plates may be permanently coupled by such methods as welding, or they may be detachably coupled by temporary fasteners or clamps. The latter embodiment provides a versatile platen assembly having an exchangeable mounting surface.

The dimensions of the patterned surface may be varied to achieve the desired proportions of compliance and rigidity. In general, the mounting surface 64 makes up to between about 20 to 95% of the total upper surface area but may be varied according to the pad thickness and modulus, as well as the applied polishing pressure. In a specific embodiment shown in FIG. 4 having a diameter of about twenty (20) inches, the groove depth is about 0.250 inches and the groove width is about 0.062 inches. Thus, the total surface area of the mounting area 64 is preferably about 20–95% of the total area of the platen. The diameter of the platen 41 may be varied to accommodate any substrate size such as 100 mm, 200 mm or 300 mm substrates. As a result, relative sizes of the grooves and protrusions will vary accordingly.

It is to be understood that the present invention allows for virtually limitless design variations. FIG. 4 and 5 show only one possible embodiment according to the invention. Another embodiment is shown in FIG. 6. In general, the embodiment of FIG. 6 provides a raised area and recessed area of the platen 41. Specifically, the platen 41 comprises a plurality of "broken" concentric grooves 65 intersected by radial grooves 66. The radial grooves 66 originate at a central hub 67 thereby communicating all of the features of the recessed area. The embodiments described above are merely illustrative and a person skilled in the art will recognize other embodiments within the scope of the present invention.

Figure 7:
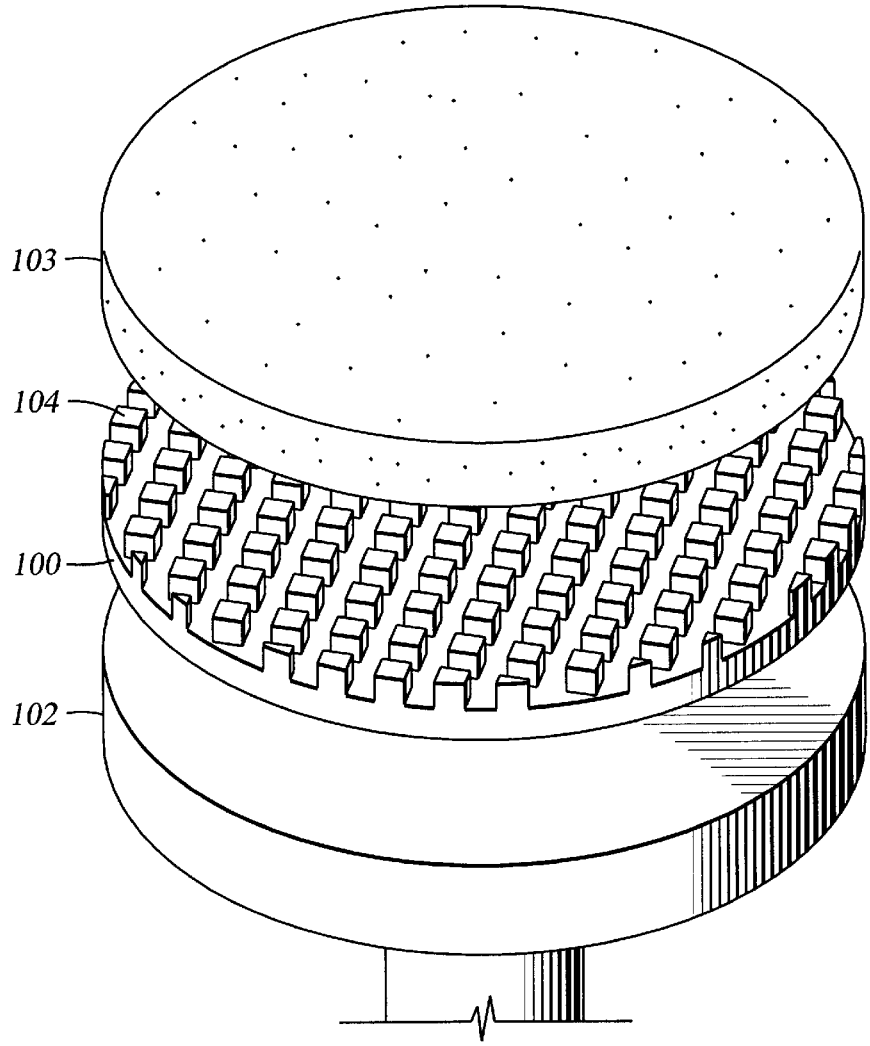
FIG. 7 is an exploded perspective view of a platen assembly including a patterned mat disposed between a polishing pad and a platen.
Figure 8:
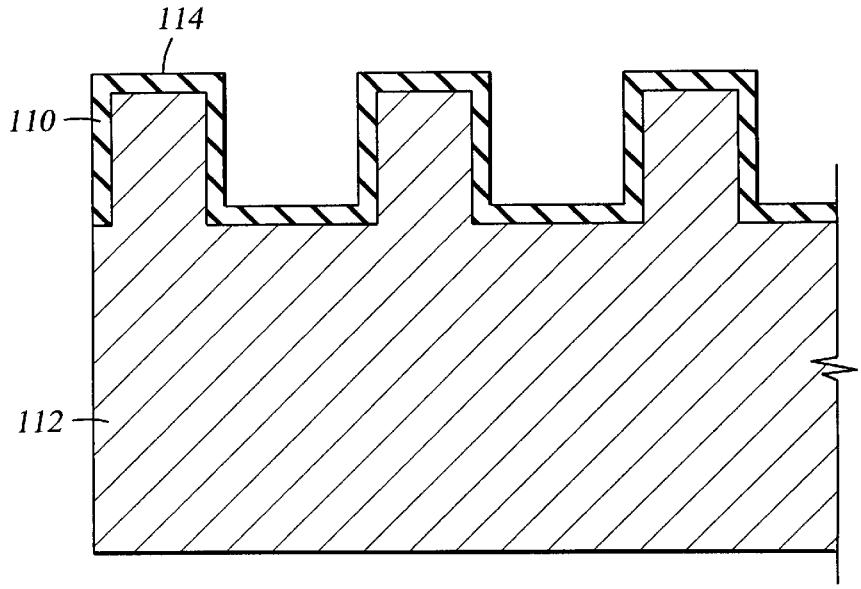
FIG. 8 is a partial cross sectional view of a platen having a coating disposed thereon.

In addition to patterning the upper surface of the platen, a patterned mat, liner or other coating could be applied to or disposed over a typical platen as shown in FIGS. 7 and 8. A hard rubber-like coating could be molded or otherwise formed to provide one of the patterned surfaces described above. Thus, FIG. 7 shows a patterned mat 100 disposed on a platen 102 and having a polishing pad 103 disposed on an upper patterned mounting surface 104. In the specific embodiment shown, the patterned mat 100 has a surface profile similar to that of the platen 41 shown in FIG. 4 and described above, however, any pattern may be used to advantage. In such an embodiment, the platen 102 preferably comprises an untextured mounting surface (as shown in FIG. 7) for securing the patterned mat 100 thereto but may also comprise a patterned surface to cooperate with the patterned mat 100 in providing additional flexibility and compliance. The polishing pad 103, patterned mat 100, and platen 102 are secured to one another by any conventional methods such as by an adhesive.

FIG. 8 is a partial cross sectional view of an alternative embodiment comprising a coating 110 disposed on a patterned platen 112. The particular surface profile of the platen 112 shown in FIG. 8 is similar to that of the platen 41 shown in FIG. 4 but it is to be understood that any pattern may be used to advantage, such as those shown in FIGS. 4–7. The coating 110 may be secured to the platen 112 by conventional methods such as by an adhesive. A polishing pad (not shown) may then be secured to the upper mounting surface 114 defined by the coating 110 and platen 112.

The material used for the patterned mat 100 and coating 110 is preferably determined according to the material of the platen. In general, the patterned mat 100 and coating 110 comprise a material more compliant than the platen. For example, where the platen is made of a metal, such as aluminum or stainless steel, the patterned mat 100 and coating 110 may comprise an elastomer such as rubber. Other materials which are known and unknown could be used to advantage.

It is to be understood that terms such as top, bottom, below, above, backside and the like are relative terms and are not intended to be limiting. Other configurations are contemplated where a substrate can be handled in different orientations.

While foregoing is directed to the preferred embodiment of the present invention, other and further embodiments of the invention may be devised without departing from the basic scope thereof, and the scope thereof is determined by the claims that follow.

What is claimed is:

1. An apparatus for polishing a substrate, comprising:

(a) a rotatable platen having a mounting surface, at least one groove formed in the mounting surface; and (b) a pad disposed on the mounting surface and bridging the at least one groove.

2. The apparatus of claim 1, further comprising a coating disposed on the mounting surface.

3. The apparatus of claim 1, wherein the pad comprises polyurethane.

4. The apparatus of claim 1, wherein the pad comprises a plastic foam.

5. The apparatus of claim 1, wherein the mounting surface is rigid.

6. The apparatus of claim 1, wherein the at least one groove extends to a perimeter of the rotatable platen.

7. The apparatus of claim 1, wherein the at least one groove and the pad define a plurality of pathways.

8. The apparatus of claim 7, wherein at least a portion of the plurality of pathways extend to a perimeter of the rotatable platen to allow fluid communication between a backside of the pad and an environment of the rotatable platen.

9. The apparatus of claim 1, wherein said the rotatable platen defines a plurality of grooves that define a patterned mounting surface.

10. The apparatus of claim 1, wherein the rotatable platen is part of a chemical mechanical polishing system.

11. The apparatus of claim 1, wherein the rotatable platen comprises aluminum.

12. The apparatus of claim 1, wherein the at least one groove are disposed in a grid pattern.

13. The apparatus of claim 1, wherein the at least one groove further comprise:

a plurality of concentric grooves; and at least one radial groove.

14. A substrate polishing apparatus, comprising:

(a) one or more polishing stations each including a rotatable platen wherein at least one of the rotatable platens has a mounting surface, at least one groove formed in the mounting surface; and (b) one or more polishing heads rotatably mounted above the rotatable platens; and (c) a polishing pad disposed on the mounting surface and bridging said groove.

15. The apparatus of claim 14, further comprising a coating disposed on the mounting surface.

16. The apparatus of claim 14, further comprising a motor coupled to the rotatable platen to selectively impart rotation.

17. The apparatus of claim 14, wherein the mounting surface is rigid.

18. The apparatus of claim 14, wherein the at least one groove and the pad define a plurality of pathways.

19. The apparatus of claim 18, wherein at least a portion of the plurality of pathways extend to a perimeter of the rotatable platen to allow fluid communication between a backside of the pad and an environment of the rotatable platen.

20. The apparatus of claim 14, wherein the rotatable platen defines a plurality of grooves that define a patterned mounting surface.

21. A rotatable platen assembly for a polishing apparatus, comprising:

(a) a mat having a mounting surface; at least one groove formed in the mounting surface; and (b) a pad disposed on the mounting surface and bridging the groove.

22. The rotatable platen assembly of claim 21, wherein the mounted surface is rigid.

23. The rotatable platen assembly of claim 21, wherein the at least one groove extends to a perimeter of the mat.

24. The rotatable platen assembly of claim 21, wherein the mat comprises aluminum.

25. The rotatable platen assembly of claim 21, wherein the pad comprises a plastic foam.

26. The rotatable platen assembly of claim 21, wherein the mat defines a plurality of grooves that define a patterned mounting surface.

* * * * *

UNITED STATES PATENT AND TRADEMARK OFFICE

CERTIFICATE OF CORRECTION

PATENT NO. : 6,220,942 B1
DATED : April 24, 2001
INVENTOR(S) : Robert D. Tolles, Steven T. Mear, Gopalakrishna B. Prabhu, Sidney Huey and Fred C. Redeker It is certified that error appears in the above-identified patent and that said Letters Patent is hereby corrected as shown below:

Column 7,
Line 32, please delete "said" between "wherein" and "the".

Column 8,
Line 5, please delete "and" after "mounting surface;".
Line 34, please replace "mounted" with -- mounting --.

Signed and Sealed this

Fourteenth Day of May, 2002

*Attest:*

*Attesting Officer*

JAMES E. ROGAN
*Director of the United States Patent and Trademark Office*